United States Patent [19]

Chenot

[11] Patent Number: 4,597,423

[45] Date of Patent: Jul. 1, 1986

[54] DEVICE FOR OPENING BOTTLED WATER CONTAINERS

[76] Inventor: Gary D. Chenot, 7550 Sterling Rd., Apt. 103A, Hollywood, Fla. 33024

[21] Appl. No.: 716,106

[22] Filed: Mar. 26, 1985

[51] Int. Cl.[4] ..... B65B 3/04

[52] U.S. Cl. ..... 141/330; 141/392; 141/289; 141/331; 222/146.6

[58] Field of Search ..... 141/19, 329, 330, 363–366, 141/392, 285, 331–345, 98; 222/146.6

[56] References Cited

U.S. PATENT DOCUMENTS

| | | | |
|---|---|---|---|
| 203,924 | 5/1878 | Ladd | 141/330 |
| 1,142,210 | 6/1915 | Wagner | 141/330 |

*Primary Examiner*—Houston S. Bell, Jr.
*Attorney, Agent, or Firm*—Joseph Zallen

[57] ABSTRACT

The invention comprises a refrigerated water cooler having seat for supporting an inverted water bottle and an interior inverted funnel whose narrow upper portion terminates in a knife edge. Insertion of the inverted water bottle causes the sealed mouth to engage the knife edge, open the seal and permit water to flow into the funnel and then into the cooling and dispensing portion of the cooler.

4 Claims, 6 Drawing Figures

DEVICE FOR OPENING BOTTLED WATER CONTAINERS

BACKGROUND OF THE INVENTION

This invention relates to a device for opening bottled water containers. In particular it relates to a device whereby the insertion of the sealed container into proper position in the refrigerating and dispensing unit of a water cooler automatically opens the bottle and allows its contents to flow.

Bottled water coolers typically comprise a body portion which contains the refrigerating and dispensing section and which supports inverted large bottles of water. Prior to this present invention, it was necessary to open the bottle before inserting it upside down on the support gasket of the cooler. Because of the weight and size, there is a great deal of spilling of the water. The inventor is not aware of any prior art which has been directed to this problem of bottled water containers.

One object of the present invention is to provide a modification of the present day water coolers so that the inversion of a sealed water bottle into conventional position on top of the water cooler will automatically open the seal and permit the water to flow into the cooler.

Other objects and advantages of this invention will be apparent from the descriptions and claims which follow, taken together with the appended drawings.

SUMMARY OF THE INVENTION

The invention comprises broadly a water cooler including a refrigerated container and dispenser and a seat in the container for supporting an inverted water bottle. The mouth of the bottle is located within the container when the inverted bottle is supported on the seat. Within the container is an inverted funnel whose narrow upper portion terminates in a knife edge. Insertion of the inverted water bottle causes the sealed mouth to engage the knife edge, opening the seal and permitting water to flow into the funnel and thence into the cooling and dispensing portion. The position of the funnel is such that it engages the sealed cap when the inverted water bottle is aligned on the top opening of the container.

Because of its construction the user merely has to invert the sealed water bottle onto the open seating gasket of the cooler and when the bottle is properly aligned it both seats and automatically opens the seal without any spilling of water.

SPECIFIC EXAMPLE OF INVENTION

Figure 1:
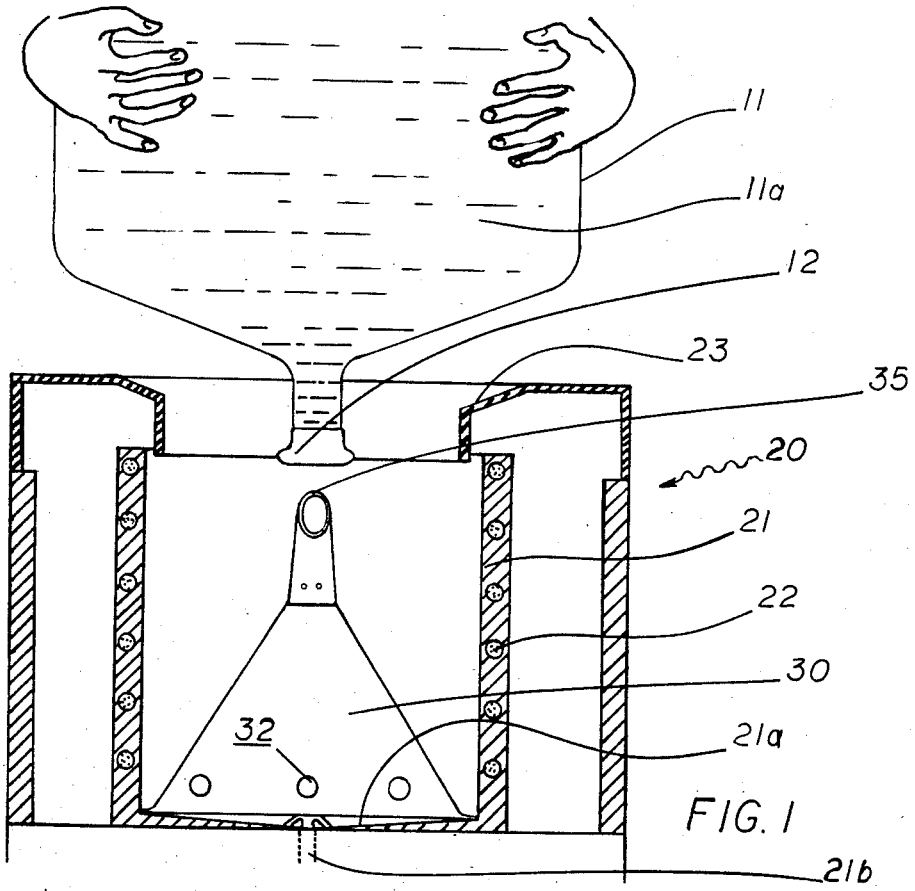
FIG. 1 is a partial vertical section view, showing a sealed bottle being inserted into a water cooler which includes the invention.
Figure 2:
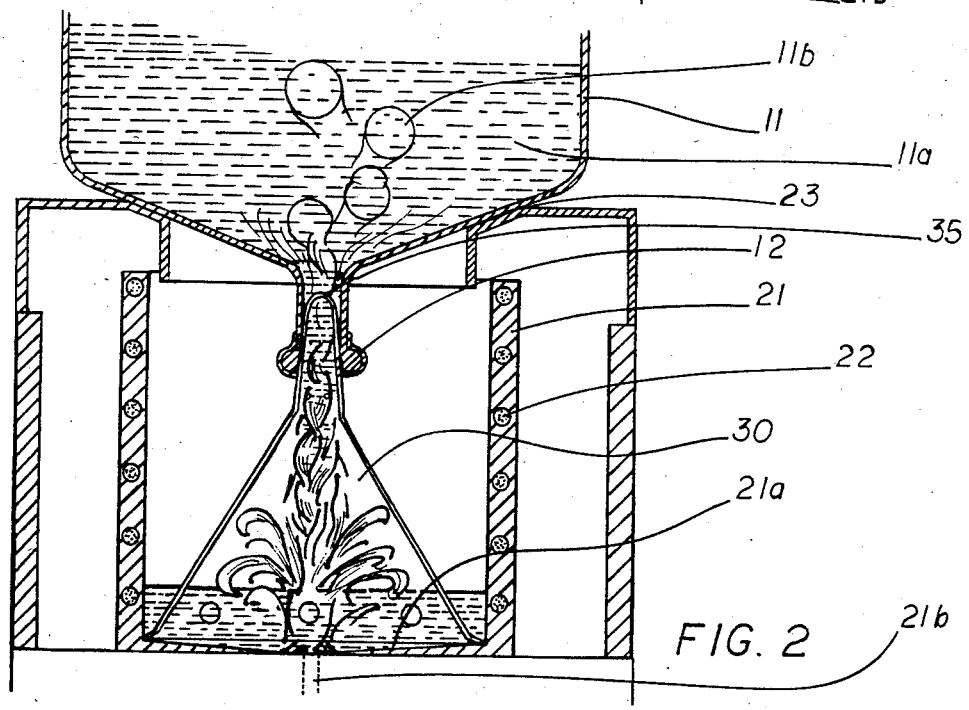
FIG. 2 shows the bottle supported in cooperating condition.
Figure 3:
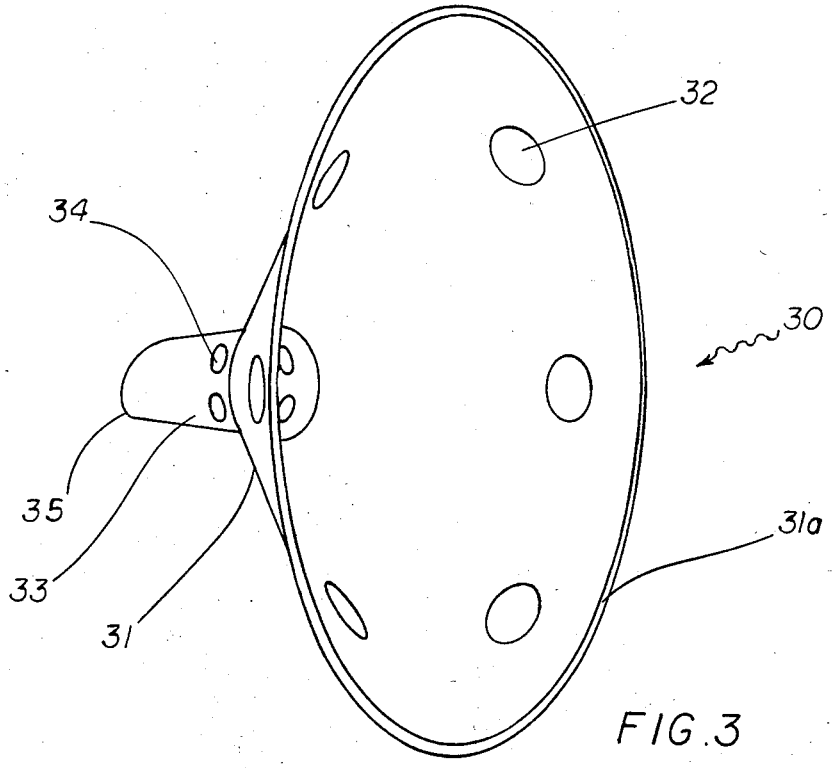
FIG. 3 is a front three-quarter view of the unit used to modify the conventional water cooler.
Figure 4:
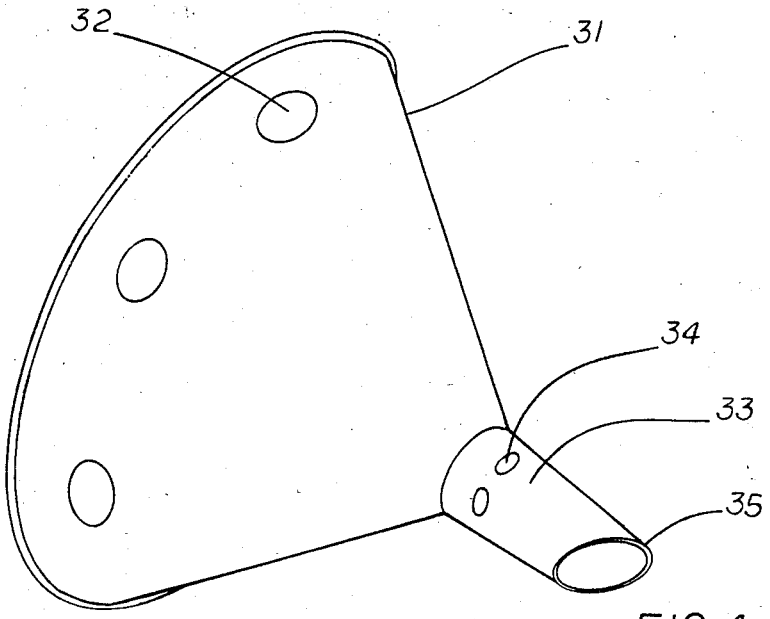
FIG. 4 is a back three-quarter view of the unit.

With reference to the drawings, FIG. 1 shows a pair of hands 10 holding a sealed water bottle 11 in upside-down position with its cap 12 sealing the mouth of the bottle 11 so that the water 11*a* remains within the bottle and does not spill therefrom until after the mouth of the bottle 11 is in proper vertical alignment with a water cooler 20. The latter comprises a refrigerated container 21 that supports a series of refrigerating coils 22 in a manner well known in the art. The refrigerated container 21 contains a sloping bottom 21*a* that includes a drain hole 21*b* at its lowest portion. Water cooler 20 also includes a support structure that surrounds the refrigerated container 21 and comprises an obliquely downwardly and inwardly arranged gasket seat 23 over the mouth of the refrigerated container 21. The slope of seat 23 preferably, but not necessarily, conforms to the slope of the bottle 11 to enable the seat 23 to support the inverted bottle 11 securely. Preferably, but not necessarily, seat 23 is so arranged that when it holds bottle 11 in inverted position, the top of the latter is vertically aligned over the drain hole 21*b*.

The modification unit of the present invention comprises a funnel 30 (see FIGS. 1 to 4) preferably of metal and having a lower conical portion 31 provided with a circular flange 31*a* surrounding the base of the funnel. A plurality of drain holes 32 are circumferentially spaced around the conical portion 31 shortly above the flange 31*a*. A tubular piercing portion 33 in the form of a pipe extends from the narrow end of the funnel 30. Drain holes 34 may also be provided in circumferentially spaced relation around the pipe forming tubular piercing portion 33. The outer end of the latter is sharply cut diagonally to provide a tubular piercing portion with a knife edge 35 at the end of the pipe. When the present invention is in operating condition, the flange 31 of the conical portion 31 of funnel 30 rests on the inwardly and downwardly sloping bottom 21*a* in closely spaced relation to the inner wall of refrigerated container 21. To assure that the tubular piercing portion 33 is vertically aligned over the drain hole 21*b*, the outer circumference of flange 31*a* is almost as large as the circumference of the bottom 21*a* of the refrigerated container 21. The dimensions of the funnel 30 and refrigerated container 21 are so related that the knife edge 35 pierces the cap 12 of an inverted water bottle 11 just before the bottle rests on seat 23.

Referring again to FIGS. 1 and 2, it is seen that the inverted water bottle 11 remains sealed until the sealed cap 12 is pierced when the latter is lowered to engage and be pierced by the knife edge 35. Piercing the cap 12 enables the water 11*a* to flow by gravity from the opened water bottle 11 to the refrigerated container 21. Drain holes 32 and 34 allow air bubbles 11*b* to rise from the refrigerated container 21 into the bottle 11 as the latter is emptied of water and thus assures a complete emptying of water from the bottle 11.

Figure 5:
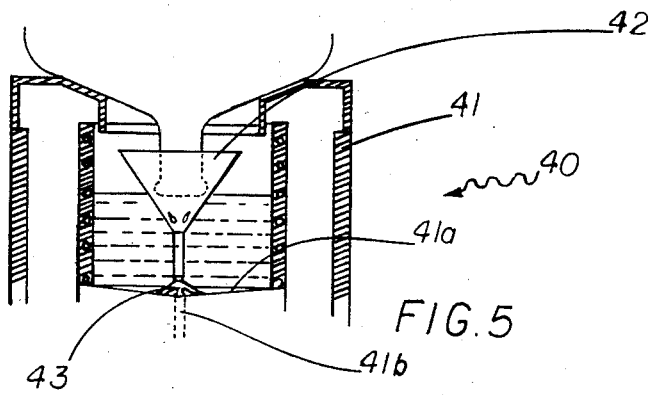
FIG. 5 is a partial vertical sectional view of the old art, wherein the bottle cap must be removed before inserting the cooler.

FIG. 5 shows the arrangement of typical prior art coolers. In the prior art, a conventional unmodified water cooler 40 included a refrigerated container 41 with a sloping bottom wall 41*a* and a drain hole 41*b* at the lowest portion of the bottom wall 41*a*. The conventional funnels 42 of prior art coolers 40 were oriented with the base or widest part of the funnel uppermost and the pipe extending downward from the narrow end of the funnel to be supported by a frusto-conical stand 43 surrounding drain hole 41*b*. Since this device required the cap 12 of the water bottle to be opened before the bottle was inverted during its placement onto the support seat 23, considerable water spillage was possible. The present invention does not require the cap 12 to be opened until after the water bottle 11 is in position over the mouth of the refrigerated container 21.

Figure 6:
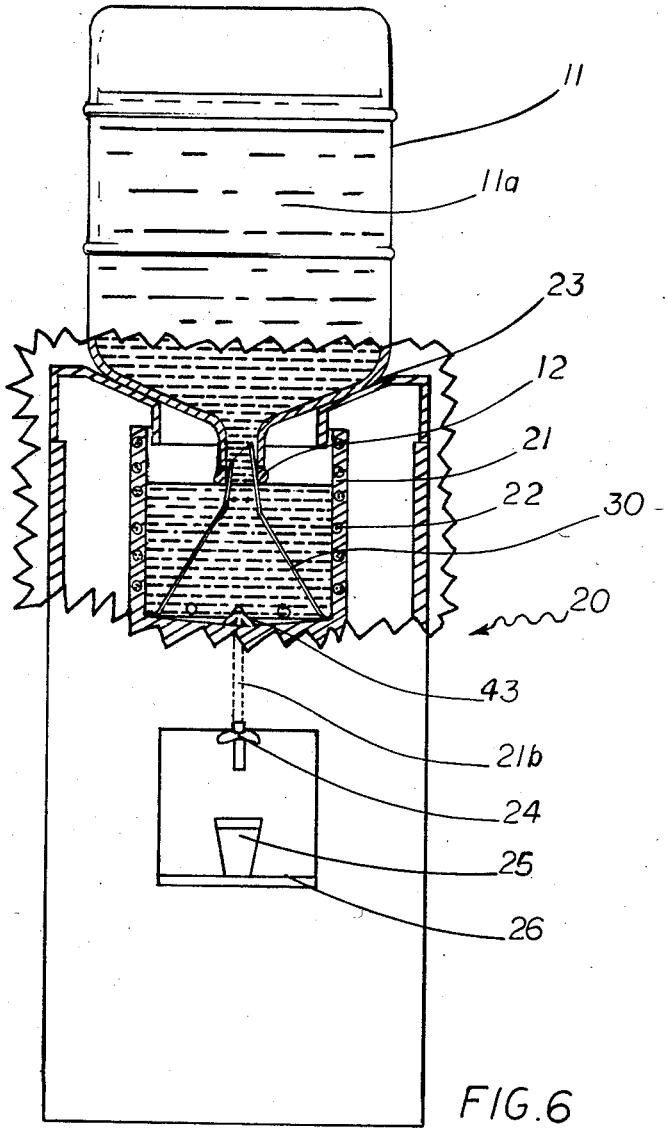
FIG. 6 is a front view with partial sectioning showing a bottle in position on a water cooler modified according to this invention.

The conventional frusto-conical stand 43 of prior art devices can be used with the present invention as shown in FIG. 6. The conventional stand 43 is provided with circumferentially spaced openings that permit water in the refrigerated container 21 to reach the drain hole 21*b*. A conventional exit pipe 44 for water that leads to a conventional valve 45 over a conventional cup supporting ledge 46 that supports a cup 47 directly below the exit pipe 44 is included with the present invention as with the prior art.

What is claimed is:

1. In a water cooler comprising a refrigerated container and a seat for supporting an inverted water bottle directly over the mouth of said refrigerated container so that the mouth of said bottle is located within said refrigerated container when said inverted bottle is supported on said seat, the improvement comprising an inverted funnel having a frusto-conical portion connected to a tubular portion terminating in a slanted knife edge; said funnel being supported within said container on the wide end of said frusto-conical portion, the dimensions of said container and said funnel being so related to one another and said bottle that a sealed cap for said inverted water bottle remains spaced from said knife edge until said inverted bottle has its mouth aligned over the mouth of said container and said knife edge extends through said cap immediately before said inverted water bottle lowers onto a supporting portion on said seat so that water flows through said tubular portion, through said frusto-conical portion and into said container thereby enabling said inverted water bottle to be installed on said cooler without either exterior or interior water spillage.

2. The improvement as in claim 1, further including drain holes for said funnel to insure the upward flow of air from said container to said inverted water bottle when water flows from said inverted water bottle into said container.

3. The improvement as in claim 1, further characterized by a flange extending outwardly said wide end of said frusto-conical portion, said flange being slightly smaller than the size of the floor of said container to insure reasonable alignment of said funnel within said container.

4. A device for modifying a conventional water cooler comprising an inverted funnel having a frusto-conical portion connected to a tubular portion terminating in a slanted knife edge; said funnel being supported within said container on the wide end of said frusto-conical portion, the dimensions of said container and said funnel being so related to one another and said bottle that a sealed cap for said inverted water bottle remains spaced from said knife edge until said inverted bottle has its mouth aligned over the mouth of said container and said knife edge extends through said cap immediately before said inverted water bottle lowers onto a supporting portion on said seat so that water flows into said tubular portion, through said frusto-conical portion and into said container, thereby enabling said inverted water bottle to be installed on said cooler without either exterior or interior water spillage.

* * * * *